US010465472B2

(12) United States Patent
Shampine

(10) Patent No.: US 10,465,472 B2
(45) Date of Patent: Nov. 5, 2019

(54) DEPLOYMENT VALVES OPERABLE UNDER PRESSURE

(71) Applicant: SCHLUMBERGER TECHNOLOGY CORPORATION, Sugar Land, TX (US)

(72) Inventor: Rod William Shampine, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 46 days.

(21) Appl. No.: 15/550,674

(22) PCT Filed: Feb. 10, 2016

(86) PCT No.: PCT/US2016/017250

§ 371 (c)(1),
(2) Date: Aug. 11, 2017

(87) PCT Pub. No.: WO2016/130617

PCT Pub. Date: Aug. 18, 2016

(65) Prior Publication Data

US 2018/0038195 A1 Feb. 8, 2018

Related U.S. Application Data

(60) Provisional application No. 62/115,773, filed on Feb. 13, 2015.

(51) Int. Cl.

| | |
|---|---|
| ***E21B 34/04*** | (2006.01) |
| ***E21B 49/08*** | (2006.01) |
| ***E21B 33/06*** | (2006.01) |

(52) U.S. Cl.

CPC ..... *E21B 34/045* (2013.01); *E21B 33/06* (2013.01); *E21B 34/04* (2013.01); *E21B 49/08* (2013.01); *E21B 49/087* (2013.01)

(58) Field of Classification Search

CPC ..... E21B 34/04; E21B 34/045; E21B 33/06; E21B 49/08; E21B 49/087

See application file for complete search history.

(56) References Cited

U.S. PATENT DOCUMENTS 4,325,434 A * 4/1982 Roberts ..... E21B 33/0355 137/596.14

4,940,095 A 7/1990 Newman (Continued)

FOREIGN PATENT DOCUMENTS

WO 2001020129 A2 3/2001
WO 2010064920 A1 6/2010

(Continued)

OTHER PUBLICATIONS

International Search Report and Written Opinion issued in International Patent Appl. No. PCT/US2016/017259 dated Apr. 25, 2016; 25 pages.

(Continued)

*Primary Examiner* — Yong-Suk Ro

(57) ABSTRACT

Methods for deploying a coiled tubing string into a wellbore include providing a coiled tubing having a distal end and an opposing end connected with a reel, providing a tool including a tool body, a valve operable under wellbore pressure disposed within the tool body, and a first fluid passageway and a second fluid passageway defined within the tool body. Fluid communication is established through the distal end of the coiled tubing and the first fluid passageway and the second fluid passageway, and the coiled tubing and tool are deployed into the wellbore.

27 Claims, 10 Drawing Sheets

(56) References Cited

U.S. PATENT DOCUMENTS

| | | | | |
|---|---|---|---|---|
| 6,050,338 | A * | 4/2000 | Watkins | E21B 33/043 166/348 |
| 6,164,619 | A | 12/2000 | Van Winkle et al. | |
| 6,192,983 | B1 | 2/2001 | Neuroth et al. | |
| 6,209,652 | B1 | 4/2001 | Portman et al. | |
| 6,913,084 | B2 | 7/2005 | Boyd | |
| 7,814,972 | B2 | 10/2010 | Angman et al. | |
| 8,047,295 | B2 | 11/2011 | Skeels et al. | |
| 8,146,660 | B2 | 4/2012 | Irani et al. | |
| 9,080,412 | B2 | 7/2015 | Wetzel et al. | |
| 2004/0104024 | A1* | 6/2004 | Kent | E21B 33/0355 166/85.4 |
| 2007/0051512 | A1 | 3/2007 | Markel et al. | |
| 2007/0137866 | A1 | 6/2007 | Ravensbergen et al. | |
| 2007/0162235 | A1* | 7/2007 | Zhan | E21B 49/008 702/6 |
| 2009/0084558 | A1 | 4/2009 | Bloom | |
| 2009/0260804 | A1 | 10/2009 | Mydur et al. | |
| 2010/0104372 | A1 | 4/2010 | Lawson et al. | |
| 2010/0155054 | A1 | 6/2010 | Innes et al. | |
| 2010/0163243 | A1 | 7/2010 | Sbordone | |
| 2010/0230112 | A1 | 9/2010 | Cox et al. | |
| 2011/0267922 | A1 | 11/2011 | Shampine et al. | |
| 2011/0272148 | A1 | 11/2011 | Lovell et al. | |
| 2012/0125622 | A1 | 5/2012 | Melancon et al. | |
| 2013/0341539 | A1* | 12/2013 | Hughes | E21B 29/08 251/1.3 |
| 2014/0048256 | A1* | 2/2014 | Ringgenberg | E21B 49/087 166/250.01 |
| 2014/0166270 | A1 | 6/2014 | Varkey et al. | |
| 2014/0231075 | A1 | 8/2014 | Springett et al. | |
| 2016/0215584 | A1* | 7/2016 | Tennant | E21B 29/04 |

FOREIGN PATENT DOCUMENTS

| | | | |
|---|---|---|---|
| WO | 2014074099 | A1 | 5/2014 |
| WO | 2016130612 | A1 | 8/2016 |
| WO | 2016130619 | A1 | 8/2016 |
| WO | 2016130620 | A1 | 8/2016 |

OTHER PUBLICATIONS

International Search Report and Written Opinion issued in International Patent Appl. No. PCT/US2016/017256 dated May 3, 2016; 17 pages.

International Search Report and Written Opinion issued in International Patent Appl. No. PCT/US2016/017254 dated May 3, 2016; 14 pages.

International Search Report and Written Opinion issued in International Patent Appl. No. PCT/US2016/017243 dated May 17, 2016; 11 pages.

International Search Report and Written Opinion issued in International Patent Appl. No. PCT/US2016/017250 dated May 11, 2016; 10 pages.

* cited by examiner

DEPLOYMENT VALVES OPERABLE UNDER PRESSURE

RELATED APPLICATION INFORMATION

This Patent Document claims priority under 35 U.S.C. § 120 to U.S. Provisional Patent Application No. 62/115,773 filed Feb. 13, 2015, the disclosure of which is incorporated by reference herein in its entirety.

FIELD

The present disclosure is related in general to wellsite equipment such as oilfield surface equipment, downhole assemblies, coiled tubing (CT) assemblies, slickline and assemblies, and the like.

BACKGROUND

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like.

In the oilfield, downhole tools are commonly used to perform measurements and services in wells. These tools are necessarily shaped like the inside of a well, typically long and narrow. The length of these tools is dependent on what function they are to perform, and additional functions typically impart additional length. As more and more sophisticated functions are performed down hole, these tools have grown in length to the point where installing them in the well bore has become a significant challenge in the face of maintaining well control while this is performed. This process of placing tools into the well bore is referred to as deployment.

In spooled conveyance services such as coiled tubing, wireline, and slickline, downhole tools need to be transferred from the reel to inside the well bore. This transfer may be accomplished using a long riser with the conveyance attached to the top of the long riser. In this method, the tools are either pulled into the bottom of this riser, or are assembled into it. The riser is then attached to the well, is pressure tested, then the tools are run into the well. In an embodiment, an 'easier to run' service is utilized to place the tools in the well, followed by a 'harder to run' service do the running in hole. In this embodiment, the downhole tools are provided with an additional part known as a deployment bar. This deployment bar is intended to provide a surface against which blowout preventers can both grip and seal. In the case where the 'harder to run' service is coiled tubing, wireline or slickline may be used to pre-place the tools in the coiled tubing blow out preventer. The deployment bar used will be selected to have a diameter substantially equal to the coiled tubing diameter.

The most complex method of deployment is one in which the tool is moved inside the pressure barrier in sections. Sections of the tool are installed in the well using the riser method and blow out preventer(s) are closed on special areas of the tool (called deployment bars) to seal in the well bore pressure. Once this seal is made, the riser may be depressurized and another section of tool may be installed. This method can accommodate much more complex and delicate tools, because the sealing function is only performed on designated areas of the tool. During deployment, some method and/or apparatus must be used to prevent fluid flow across the joints in the tool during deployment.

It remains desirable to provide improvements in oilfield surface equipment and/or downhole assemblies such as, but not limited to, methods and/or systems for deploying coiled tubing into wellbores.

SUMMARY

This section provides a general summary of the disclosure, and is not a necessarily a comprehensive disclosure of its full scope or all of its features.

In a first aspect of the disclosure, a method for deploying a coiled tubing string into a wellbore is disclosed which includes providing a coiled tubing having a distal end and an opposing end connected with a reel, providing a tool including a tool body, a valve operable under wellbore pressure disposed within the tool body, and a first fluid passageway and a second fluid passageway defined within the tool body. Fluid communication is established through the distal end of the coiled tubing, the first fluid passageway and the second fluid passageway. The coiled tubing and tool are deployed into the wellbore. The method may further include selectively interrupting the fluid communication by closure of the valve while exposed to wellbore pressure. The tool may be secured in the wellbore by one or more blow out preventer rams, and the valve is exposed to wellbore pressure below the one or more blow out preventer rams. In some aspects, the fluid communication is selectively interrupted by closure of the valve when exposed to the wellbore pressure, while pressure above the one or more blow out preventer rams decreases.

In some embodiments, the tool is secured in the wellbore by two sets of blow out preventer rams defining a cavity there between, and the fluid communication is selectively interrupted by closure of the valve when pressure in the cavity is increased above pressure in the first fluid passageway and the second fluid passageway. In some cases, the fluid communication is selectively interrupted by closure of the valve by set down load. In some other cases, the fluid communication is selectively interrupted by closure of the valve by mechanical engagement with a device adjacent the tool.

Embodiments according to the disclosure may use a valve, or plurality of valves, which are selected from a poppet valve, a disc valve, a rotating sleeve valve, a rotating sliding sleeve valve, spool valve, a ball valve, a sliding sleeve valve or combinations thereof. In some cases, the valve remains closed with or without a valve actuating means being applied, when pressure in the second fluid passageway is higher than pressure in the first fluid passageway. The valve may open when pressure in the first passageway is higher than pressure in the second passageway, notwithstanding any state of a valve actuating means. Also, the tool body may include a second valve operable under wellbore pressure disposed within the tool body. Testing means may be provided in some cases, to verify the sealing action of the valves.

In some other embodiments of the disclosure, systems for deploying coiled tubing include a coiled tubing having a distal end and an opposing end connected with a reel, and a tool having a tool body, a valve operable under wellbore pressure disposed within the tool body, and a first fluid passageway and a second fluid passageway defined within the tool body, with the coiled tubing, the first fluid passageway and the second fluid passageway are in fluid communication. The system may further include a wellbore, wellhead and a blowout preventer within which the coiled tubing and tool are deployable. Also, a treatment fluid flowable through the distal end of the coiled tubing, the first fluid passageway and the second fluid passageway, may be included. Fluid communication between the first fluid passageway and the second fluid passageway may be selectively interruptable by closure of the valve while exposed to wellbore pressure. In some cases, the fluid communication is selectively interruptable by closure of the valve while exposed to the wellbore pressure, and while pressure above the one or more blow out preventer rams decreases.

In yet other embodiments of the disclosure, apparatus include a tool body, a valve operable under wellbore pressure disposed within the tool body, and a first fluid passageway and a second fluid passageway defined within the tool body. The first fluid passageway and the second fluid passageway are in fluid communication, and fluid communication is selectively interruptible with the valve. In some instances, the fluid communication is selectively interruptible by closure of the valve when exposed to wellbore pressure. The apparatus may be secured by one or more blow out preventer rams, where the fluid communication is selectively interruptible by closure of the valve while exposed to the wellbore pressure and while pressure above the one or more blow out preventer rams decreases. Fluid communication may also be selectively interruptible by closure of the valve by set down load, or fluid communication selectively interruptible by closure of the valve by mechanical engagement with a device adjacent the tool.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
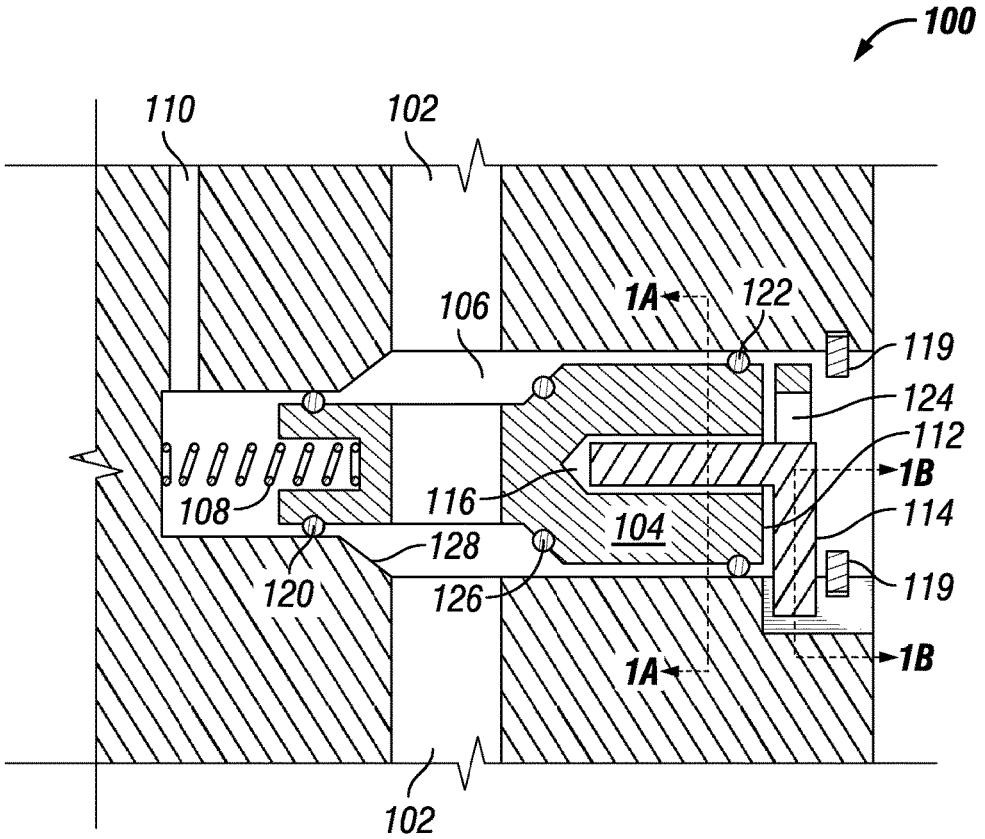
FIGS. 1, 1A and 1B illustrate in cross-sectional views, an embodiment of a tool according to the disclosure.

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments of the disclosure provide methods, apparatus and systems to open and close one or more passages through a tool placed in wellhead equipment, such as a blow out preventer, while under well bore pressure to facilitate safe deployment. In some aspects, methods include deploying a coiled tubing string into a wellbore by providing a coiled tubing having a distal end and an opposing end connected with a reel upon which coiled tubing is transported and from which the coiled tubing is deployed into the wellbore. A tool having a tool body, a valve operable under wellbore pressure contained within the tool body, a first fluid passageway and a second fluid passageway are defined within the tool body and fluid communication through the distal end of the coiled tubing and the first and second fluid passageways is established. The fluid communication is interrupted, or otherwise selectively interruptible, by closure of the valve when exposed to wellbore pressure, when pressure is applied to portions of the tool, by set down load, by mechanical engagement with a device adjacent the tool, or the like. In some aspects, the valve may be one of a poppet valve, a disc valve, a rotating sleeve valve, a rotating sliding sleeve valve, a spool valve, a ball valve, or a sliding sleeve valve.

Some embodiments of the disclosure utilize an element of the deployment blow out preventer to operate the tool passage isolation valve. The minimum deployment blow out preventer will have one or more pipe and slip ram functions applied to the deployment neck or bar area of the tool. In some cases, the deployment blow out preventer system may provide a tool trap, a ram that provides a shoulder against which the tool can be pushed or pulled, and/or a means to engage and move a part of the tool. In some aspects an advantage of use of valves according to the disclosure is operation by a pressure differential that is only present during deployment, as that pressure differential is produced across the deployment blow out preventer sealing ram. In some cases, the valve has two (or more) states and may be alternated between those states by cycling pressure (such as pressure across a blow out preventer ram).

Figure 1A:
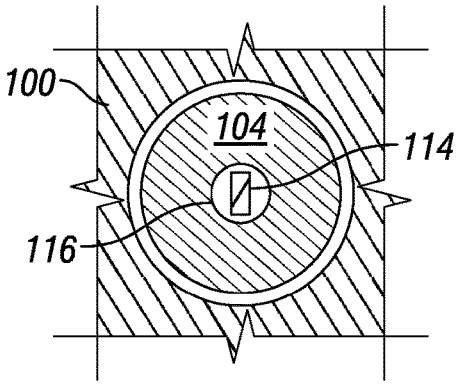
Figure 1B:
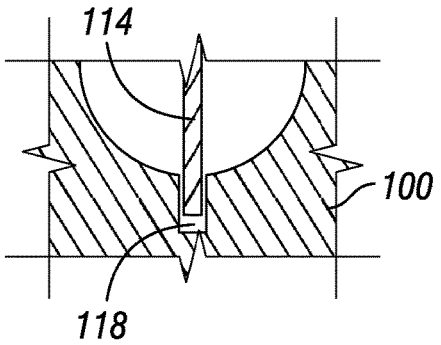

Referring now to FIG. 1, in an embodiment, a tool body 100 is provided with one or more flow passages 102 that pass through tool body 100, which allow for flow of a well treatment fluid used in a wellbore and/or subterranean formation treatment operation. A valve spool 104 is disposed with cavity 106 in the tool body 100. The valve spool 104 is shown biased in the open direction with a spring 108. The spring end of the spools is in communication with fluid or atmospheric pressure above the pipe or pipe/slip ram via passage 110. The other end 112 of the spool valve 104 is in fluid communication with the area of the tool located below the pipe or pipe/slip ram, as depicted below in FIG. 2. An anti-rotation pin assembly 114 engages a corresponding hole 116 in valve spool 104 as shown, and as depicted in the cross sectional illustration taken at "1A", and shown in FIG. 1A. A pocket 118 is provided in the tool body 100 to orient the anti-rotation pin 114 as shown, and as depicted in the cross sectional illustration taken at "1B", which is shown in FIG. 1B. Anti-rotation pin 114 is held in place by snap ring 119. Seal 120 prevents fluid and/or pressure communication between the flow passage 102 and channel 110. Seal 122 similarly prevents fluid and/or pressure communication between the flow passage 102 and the exterior of the tool via port 124.

Under normal operating conditions, valve spool 104 is in the position shown in FIG. 1 and fluid flow through the flow passage 102 is allowed in both directions. When a pipe or pipe/slip is set upon the tool body 100 and pressure is adjusted to be lower above the pipe or pipe/slip ram (a normal condition when isolation is desired), valve spool 104 is pushed inward by pressure from fluid through port 124. Seal 126 may then engages sealing surface 128. Two rubber side sealing elements (not shown) connecting between seal 122 and seal 126 may be further provided.

In some aspects, a tapered sealing surface 128 is desirable because the extrusion gap may approach zero, and under such conditions, flow is prevented through the flow passage 102. Seal 122 may be sized to be larger than seal 120 so that when the pressure above the pipe or pipe/slip ram is only slightly higher than below, the valve will remain closed. In the case where the pressure in flow passage 110 approaches the pressure below the pipe or pipe/slip ram, the valve will remain closed. When the pipe or pipe/slip ram is equalized or opened, the spring 108 will act to open the valve. If the valve spool 104 is stuck in the closed position, pumping into the flow port 102 will cause it to open because of the difference in area between seal 126 and seal 122. In the event that the valve spool 104 fails to seal during deployment or reverse deployment, the valve spool 104 may be cycled repeatedly by adjusting the pressure across the pipe or pipe/slip ram. Further, during deployment, once the valve spool 104 is closed and pressure is bled off in the flow passage 102 above the valve, the valve will tend to be held closed by the differential area between seals 126 and 124, irrespective of the pressure on flow passage 110.

Figure 2:
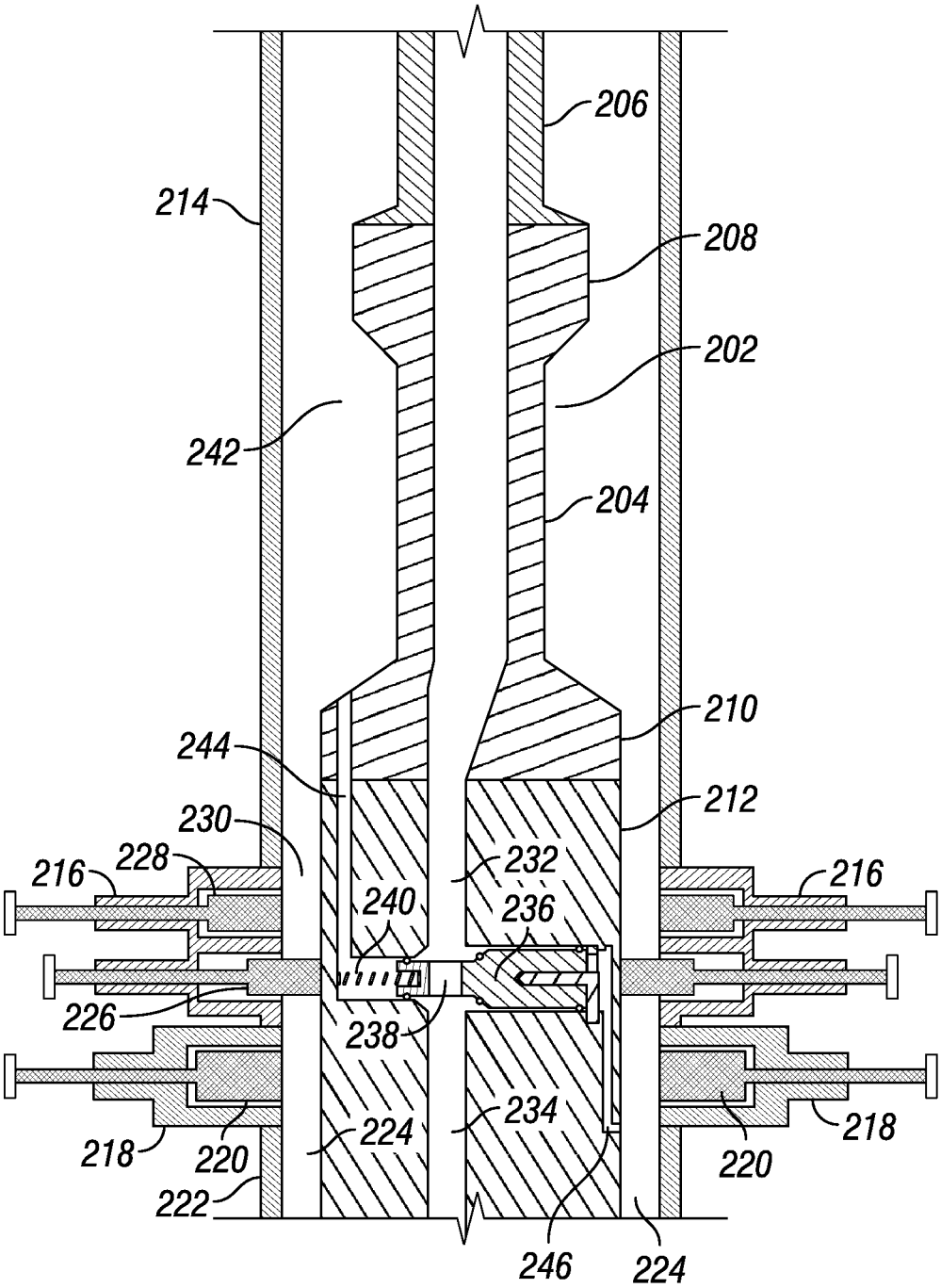
FIGS. 2 and 3 illustrate in cross-sectional views, operation of a tool in accordance with the disclosure.

Referring now to FIG. 2, a system including a coiled tubing tool and string is depicted partially deployed into a wellbore, in a cross-sectional view. The system includes a deployment bar 202 having a neck portion 204 sized like or similar in cross sectional diameter as coiled tubing 206. Deployment bar 202 further includes an upper portion 208, and lower portion 210, one or both of which may have a larger diameter than neck portion 204 as shown, or in other cases, similar diameters as neck portion 204. A distal end of coiled tubing 206 may be sealingly attached to upper portion 208 by any suitable connection. Lower portion 210 of deployment bar 202 is connected to tool body 212, which may be like or similar to tool body 100 illustrated in FIG. 1 and described above. Tool body 212 and lower portion 210 of deployment bar 202 may be connected by any suitable connection mechanism. Distal end of coiled tubing 206, deployment bar 202 and in some instances, a portion of tool body 212 are contained within riser 214, which is connected to blow out preventer 216. Blow out preventer 216 is disposed above and secured with wellhead 218, which includes master valve 220 (shown in an open position). Master valve 220 is disposed above and secured with well casing 222, which defines high pressure wellbore 224 therein. Blow out preventer 216 further houses pipe or pipe/slip ram 226 (two shown) and an optional shearing ram 228 (two shown). Rams 226 are depicted in a closed position securing tool body 212 in the upper wellbore opening 230 and high pressure wellbore 224, while shearing rams 228 are shown in an open position. In an embodiment, the rams 226 may be closed against the neck portion 204 of the deployment bar 202 to secure deployment bar 202 in the upper wellbore opening 230 and high pressure wellbore 224, as will be appreciated by those skilled in the art.

An upper portion of tool body 212 is illustrated in FIG. 2, and the upper portion includes flow passages 232 and 234 which allow for flow of a well treatment fluid used in a wellbore and/or subterranean formation treatment operation. A valve spool 236 is sealingly disposed within a cavity in the tool body 212, and includes flow passage 238 for providing fluid communication between flow passages 232 and 234. The valve spool 236 is biased in the open direction with a spring 240. The spring end of valve spool 236 is in communication with pressure 242 above rams 226 by passage 244 disposed in tool body 212 and extending through the lower portion 210 of deployment bar 202. The opposing end of valve spool 236 is in communication with pressure in wellbore 224 below rams 226 by passage 246 disposed in tool body 212. Under normal operating conditions, valve spool 236 is in the position shown in FIGS. 1 and 2 where flow through the flow passages 232, 238 and 234 is allowed in both directions. When a pipe or pipe/slip ram(s), such as rams 226, is set upon the tool body 212 as depicted in FIG. 2, in some cases it is routine to adjust pressure to be lower, or pressure otherwise decreases, above the rams 226 when isolation is desired.

Figure 3:
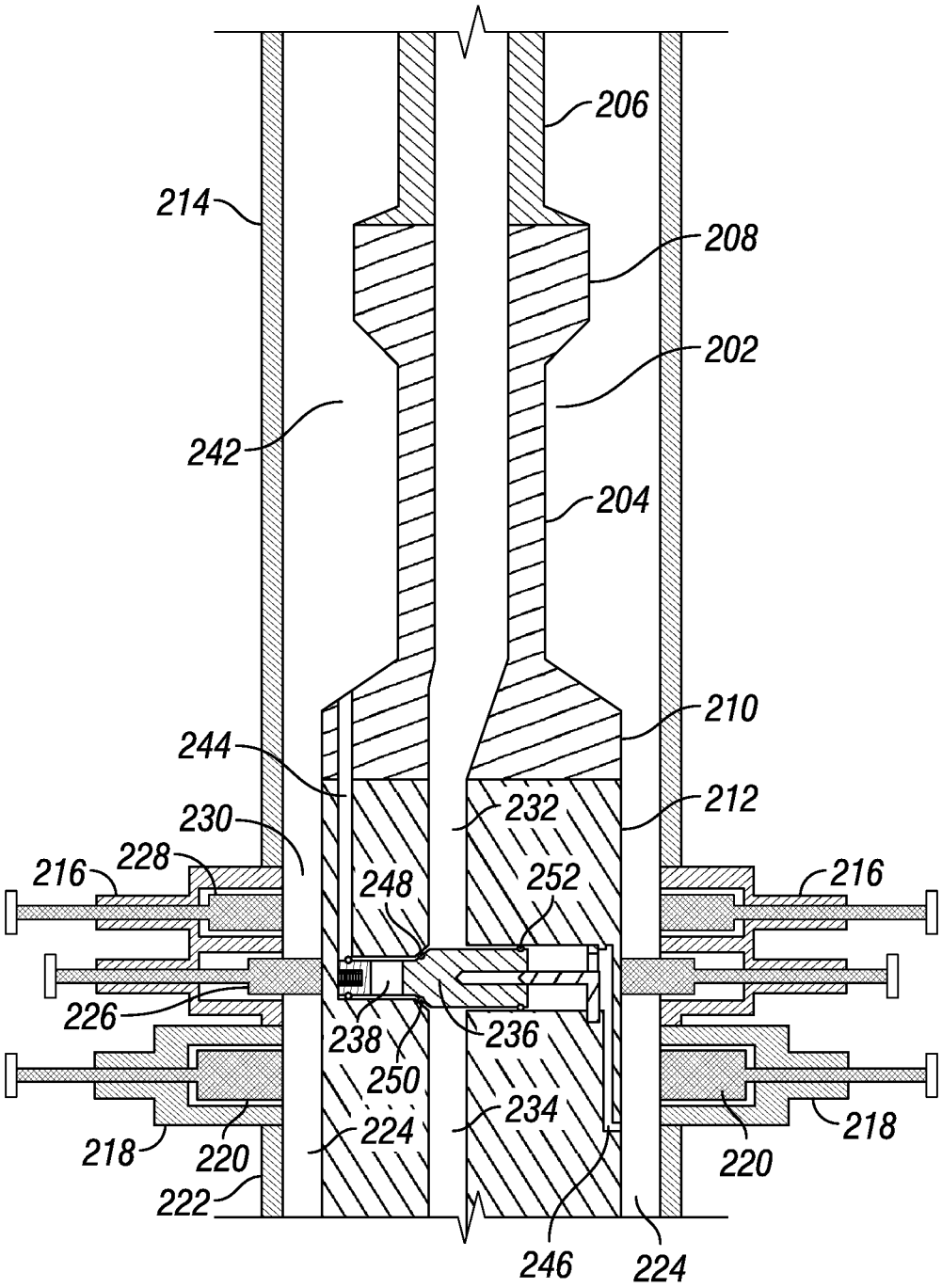

With reference to FIG. 3, which illustrates the system components illustrated in FIG. 2, as pressure 242 is decreased, either intentionally or by unplanned event, valve spool 236 is pushed inward by pressure in wellbore 224 below rams 226 pressure from fluid through passageway 246. Seal 248 then firmly engages sealing surface 250 cutting off, or otherwise isolating, flow passages 232 and 234 from one another as flow passage 238 disposed within valve spool 236 is moved into an isolated position within tool body 212, as indicated. Further, in the event that the pressure in passage 244 is then increased and begins to approach the pressure in wellbore 224, valve spool 236 will remain closed with flow passage 238 remaining isolated, until pressure 242 is equalized with pressure in wellbore 224. Under an equalized pressure condition, valve spool 236 will open as depicted in FIG. 2. Additionally, when the pipe or pipe/slip rams 226 are equalized or opened, valve spool 236 will open as depicted in FIG. 2, as well.

In some cases, valve spool 236 may be stuck, or otherwise lodged in the closed position depicted in FIG. 3, even after pressure 242 is equalized with pressure in wellbore 224. Pumping fluid at sufficient pressure into flow passage 232 will cause valve spool 236 to open because of the orientation of and area of the outer surface of valve spool 236 between seal 248 and seal 252. In the event that the valve spool 236 fails to close or seal when pressure 242 is decreased during deployment or reverse deployment, pressure 242 may be increased and equalized with pressure in wellbore 224, then pressure 242 decreased, and as necessary, repeated any sufficient number of times until valve spool 236 closes and isolates flow passage 238 by seal 248 firmly engaging sealing surface 250. Further, during deployment, once the valve spool 236 is closed, as depicted in FIG. 3, and pressure is bled off in the flow passage 232 above valve spool 236, valve spool 236 will tend to remain in the closed position by the differential area between seals 248 and 252, irrespective of the pressure present in passage 244.

Figure 4A:
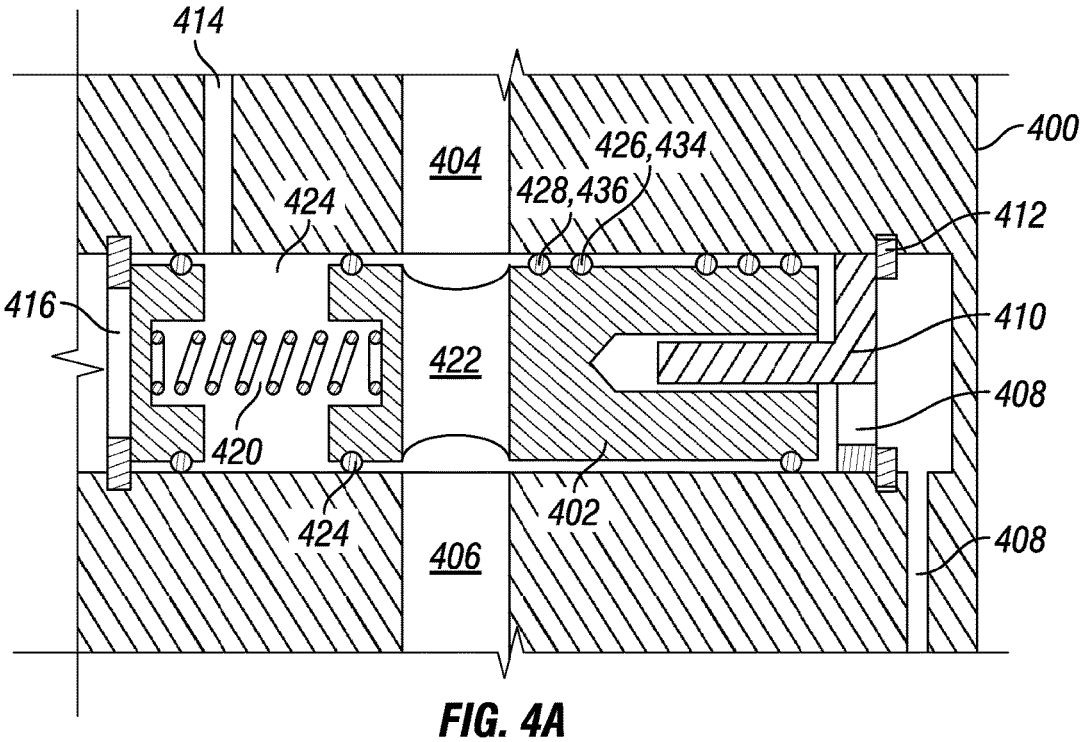
FIGS. 4A through 4C depict another embodiment of tool in cross-sectional and perspective views, in accordance with an aspect of the disclosure.
Figure 4B:
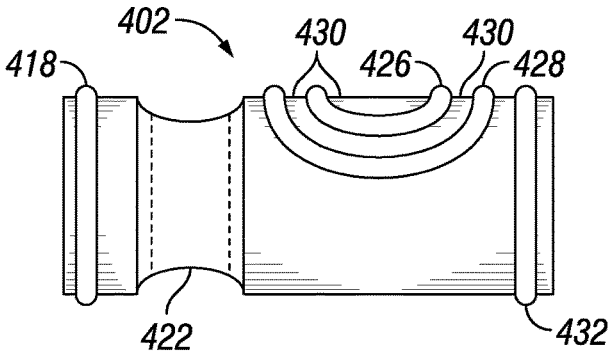
Figure 4C:
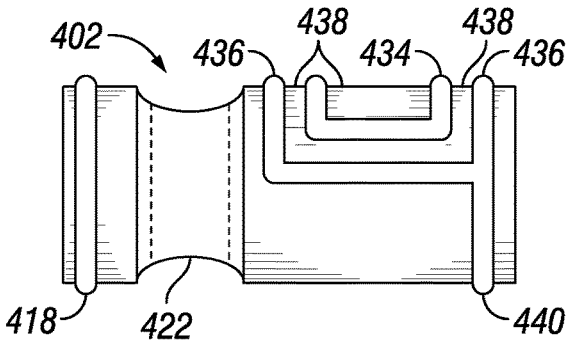

In another embodiment according to the disclosure, as shown in FIGS. 4A through 4C, a spool valve 402 is disposed in a cylinder defined within tool body 400. Referring to FIG. 4A, a cross-sectional view of the embodiment, upper passage 404 extends within tool body 400, and upper passage 404 requires the capability to be isolated from lower passage 406 (extending within tool body 400) during deployment. Tool body 400 may be positioned within a wellbore, wellhead and blow out preventer, as depicted in FIGS. 2 and 3, hereinabove. A passageway 408 providing fluid communication with the wellbore below tool body 400 and spool valve 402 is provided through tool body 400 and anti-rotation pin 410, which is held in place by snap ring 412. Passage 414 extends within tool body 400 and provides pressure communication above a blow out preventer sealing ram and the end of spool valve 402 closed by cap 416. The pressure in passage 414 is isolated from fluid flow passages 404 and 406 by seal 418. In a normal position, with pressures above and below tool body 400 and/or the sealing ram like or very similar, spring 420 biases spool valve 402 in an open position, which allows fluid communication between fluid flow passages 404 and 406 through fluid passageway 422 extending through spool valve 402. When the pressure below tool body 400 and/or the sealing ram is higher than that above, spool valve 402 moves to a closed position by fluid pressure from the wellbore below through passageway 408. Spring 420 is compressed, and fluid flow communication between fluid flow passages 404 and 406 is cut off, or otherwise isolated, as fluid passageway 422 in spool valve 402 is completely contained within opening 424.

Spool valve 402 is shown in an un-sectioned perspective view in FIG. 4B. In this embodiment, through passage 422, and O-rings or bonded seals 426 and 428 are provided around sealing area or pressure testing cavity 430 which provide sealing to further isolate upper passage 404 from lower passage 406 when spool valve 402 is in a closed position. Seal 428 provides redundant sealing, and seal 432 isolates passageway 408 (having pressure communication with the wellbore below tool body 400) from fluid flow passages 404, 406 and 422. Pressure testing cavity 430 may be in fluid communication with a testing port (not shown) for testing the seals 426 and 428, whereby fluid may be introduced under pressure to the cavity 430 and the pressure measured in the cavity 430. If there is no leakage of pressure (or leakage within an acceptable limit) from the cavity 430, the pressure test of the valve 402 is successful. In another spool valve embodiment, depicted in FIG. 4C, non-rounded seals 434 and 436 provide sealing functions around sealing area 438. The end seal is shown as provided by seal 436, which further includes a seal extension 440, although in some alternate embodiments, these may be separated. Sealing on the up-hole side as shown by seal set 426 and 428, or 434 and 436, may provide advantage as pressure from below in passage 406 may move spool valve 402 against the port formed in tool body 400 which accommodates spool valve 402, thus reducing the extrusion of seals 426 and 428, or 434 and 436, in any gap in the port. Further, such arrangement of seals minimizes the length of the seals that must move across and through the port, as the seal remains in sealingly contact with the seal bore when spool valve 402 is move from an open to closed position, and visa versa.

Figure 5:
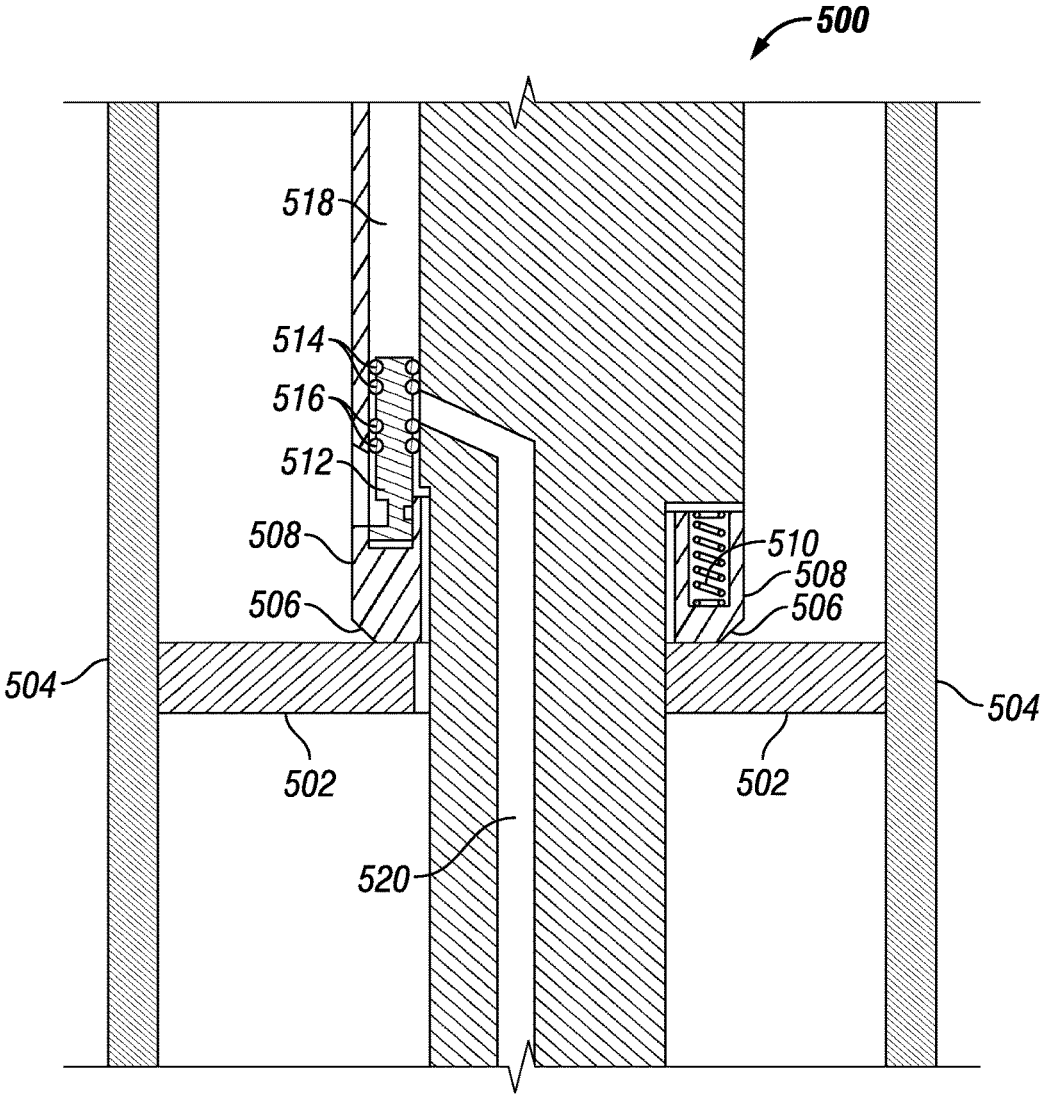
FIG. 5 depicts in a cross-sectional view, a valve arrangement which is actuated by a set down load, according to some embodiments of the disclosure.

Now referencing FIG. 5, a valve arrangement is illustrated which is actuated by a set down load, according to some embodiments of the disclosure. The tool 500 may be rested on a tool trap, rested on a specialized non-gripping blow out preventer ram, or on a partially closed blow out preventer ram (generally shown as 502) contained within wellhead equipment 504 mounted on a wellbore casing or master valve below the equipment 504. This resting area is generally shown as 506. In some alternative embodiments, the tool may be pulled up against a like or similar item as 502, or otherwise functioning in an upside down orientation, than that depicted. Collar 508 is provided with springs 510 that bias in the down position. Poppet valve 512 having seal sets 514 and 516 disposed thereon is integrated with collar 508. When shifted upward, as shown, poppet valve 512 blocks fluid flow from passageway 518 into passageway 520. Pressure from passage 520 has no effect on the poppet position because the areas of seal sets 514 and 516 are identical. In general, it is desired that pressure from below either do nothing or hold the valve closed. Pressure from above via passage 518 will act to open to poppet valve 512 collar 508 if it is not mechanically restrained by the surface 506. When the tool is moved out of contact with surface 506, the force from spring 510 pulls out poppet valve 512. Also, in some cases, if this does not shift the poppet valve 512, fluid pressure may be applied to passage 518 move poppet valve 512 into an open position. Well bore fluid pressure supplied through passageway 520 acts to resist such motion of spring 510, and poppet valve 512 will stay closed if the pressure in passageway 518 is below the well bore pressure by the equivalent pressure of spring 510.

Figure 6:
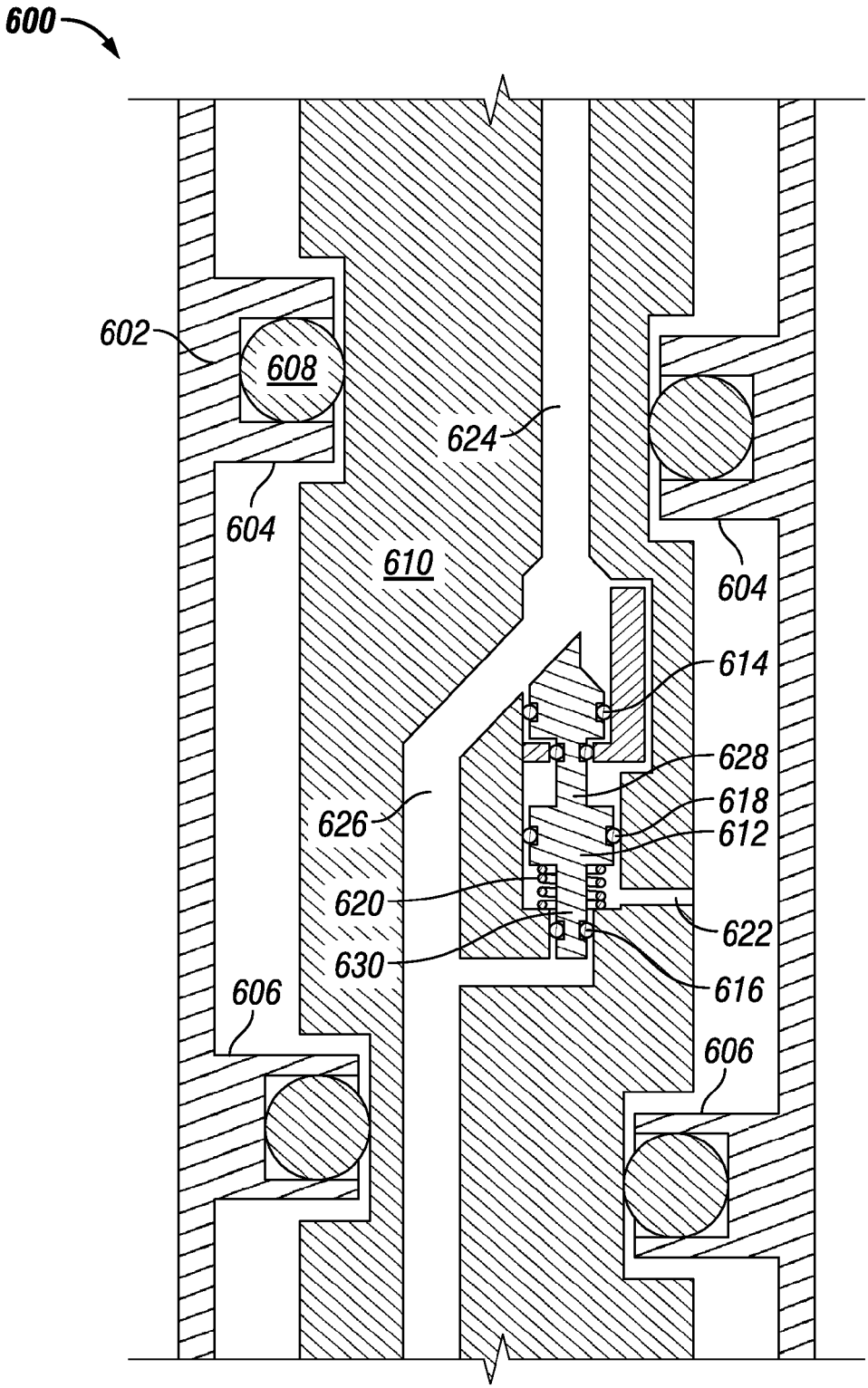
FIG. 6 illustrates in a cross-sectional view, another embodiment of a tool according to the disclosure.

Another embodiment according to the disclosure is illustrated in FIG. 6, in a cross sectional view. Tool 600 is shown disposed within a blowout preventer 602 and held in place with rams 604 and 606. Rams 604 and 606 contain seals 608 (four shown) therein for sealing against and securing exterior portions of tool body 610. Poppet valve 612 is sealingly disposed within a cavity in tool body 610 with seals 614 and 616. Poppet valve 612 further includes seal 618 disposed on the outer periphery and in sealingly contact with the cavity surface, as well as spring 620 to bias the system in the closed position. Tool 600 provides two sealing functions engaged on the tool. A side port 622 allows fluid pressure to act upon poppet valve 612 driving it upward thus isolating upper fluid passageway 624 from lower fluid passageway 626 when fluid pressure between the blow out preventer rams 604 and 606 is raised above the pressure in fluid passageway 624. Poppet valve 612 includes double rods 628 and 630 to balance out the effect of bottom side pressure when shifting poppet valve 612. However, when the poppet valve 612 establishes a seal in a closed upward position, pressure from below will act to maintain the closed position. When blow out preventer rams 604 and 606 are removed, poppet valve 612 may be pumped down, into an open position, and act as a check valve.

Figure 7:
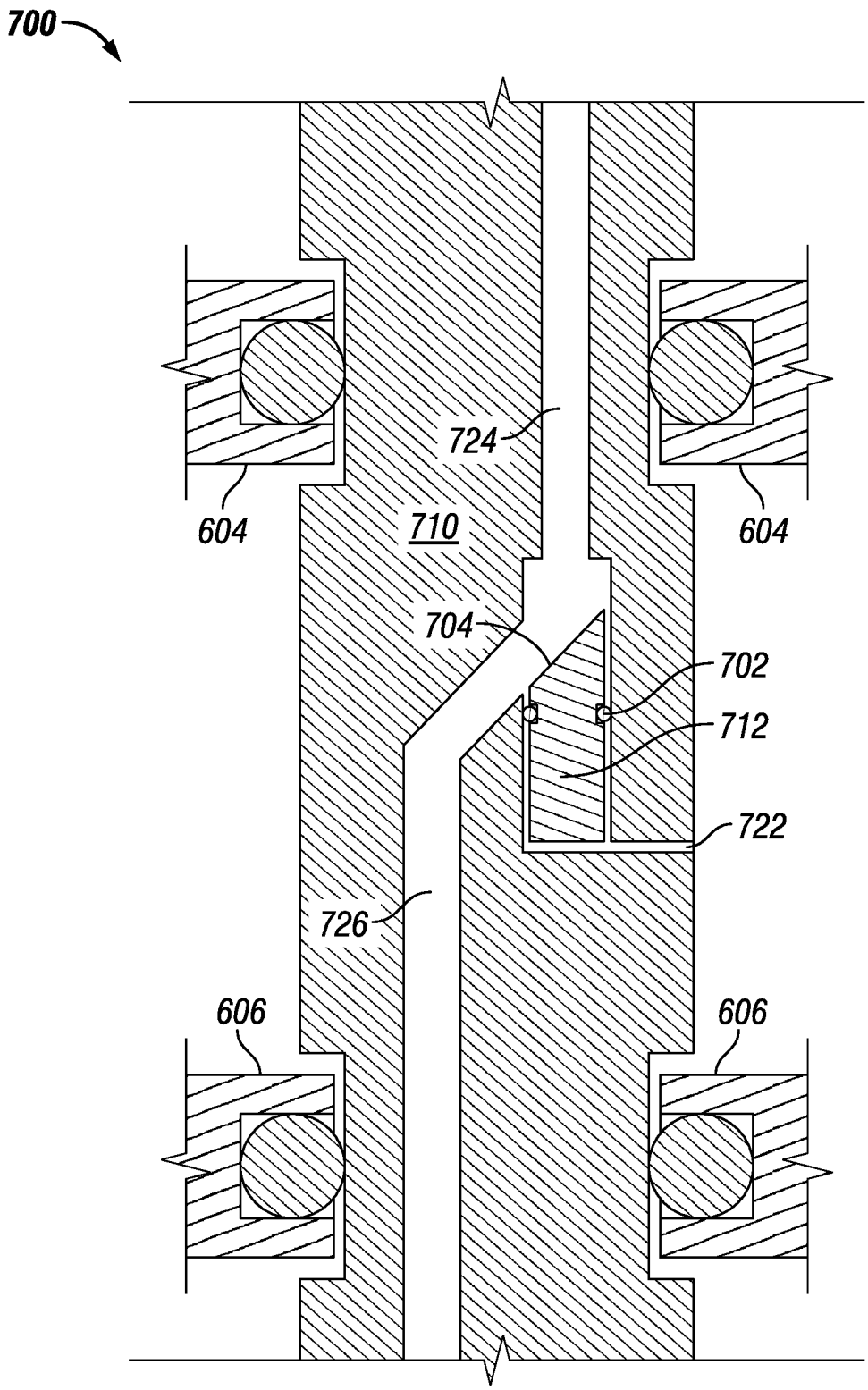
FIG. 7 depicts in a cross-sectional view, another tool embodiment, according to some embodiments of the disclosure.

FIG. 7 illustrates, in cross-sectional view, a tool 700, similar to that depicted in FIG. 6, but is a simpler version where the external pressure between blow out preventer rams acts directly on the poppet area. The system shown in FIG. 7 includes many of the same components such as rams 604 and 606 extending from a blowout preventer (not shown), where rams 604 and 606 have seals and are capable of sealing against and securing exterior portions of tool body 710. Tool 700 also includes an upper fluid passageway 724 and lower fluid passageway 726, and side a side port 722 allowing fluid pressure to act upon poppet valve 712 driving it upward thus isolating upper fluid passageway 724 from lower fluid passageway 726. Poppet valve 712 is sealingly disposed within a cavity in tool body 710 and includes seal 702 disposed on the outer periphery and in sealingly contact with the cavity surface. An additional seal (not shown) separating the external pressure and the bottom flow passage may be included as well. While an open position is shown, when in a closed position, after the blow out preventer rams 604 and 606 are removed and pressure equalized, in order to open the poppet valve 712 sufficient fluid pressure is pumped through upper fluid passageway 724 onto surface 704 of poppet valve 712, thus moving the valve to an open position. The top surface 704 of poppet valve 712 may be sloped as shown to reduce the effect of erosion. In another aspect, a conical top surface of poppet valve 712 may also be useful without requiring any orienting feature.

Figure 8:
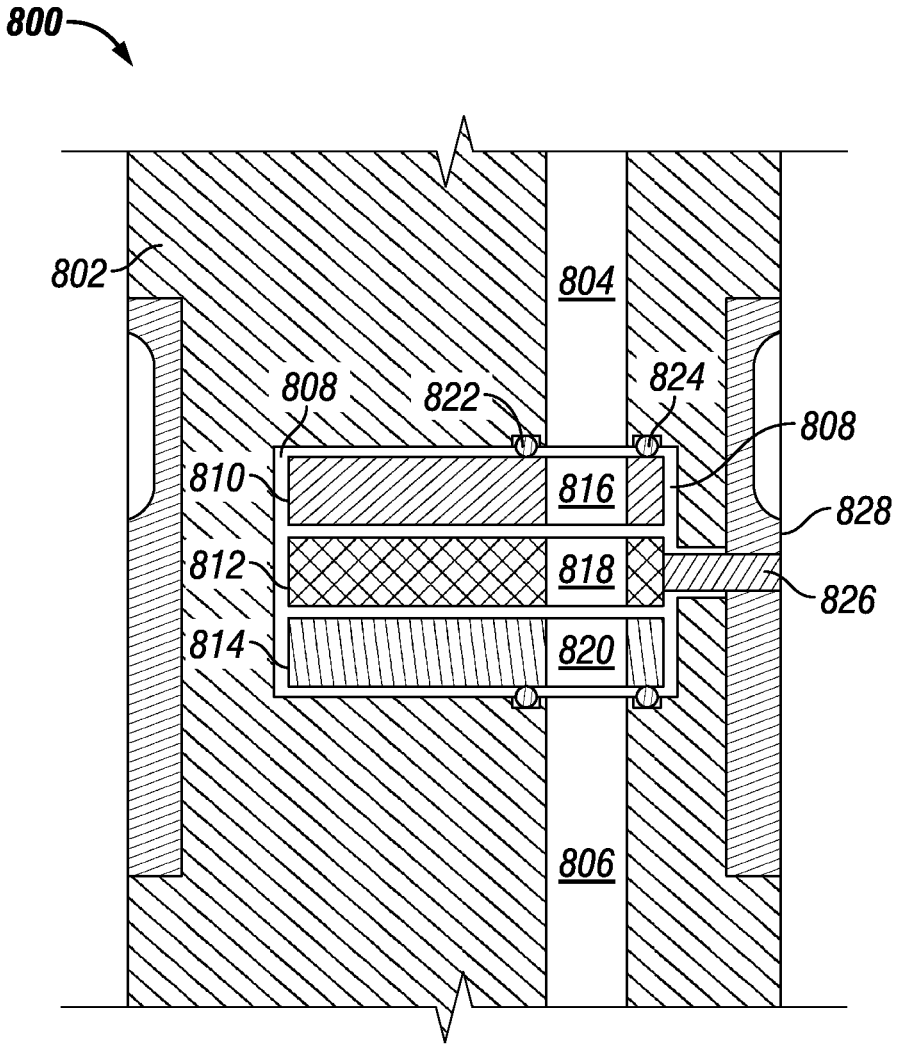
FIG. 8 illustrates in a cross-sectional view, a rotary disc valve arrangement used in some tools, according to the disclosure.

In another embodiment, illustrated in FIG. 8, a rotary valve includes three discs, which may be ceramic, ceramic coated or other suitable material. The rotary valve including the discs is used to provide flow through or isolation of upper and lower fluid passageways. Tool 800 includes tool body 802 defining upper fluid passageway 804, lower fluid passageway 806, and cavity 808 with in which discs 810, 812 and 814 are disposed. Discs 810, 812 and 814 each include passageways 816, 818 and 820 defined there through, and when the passageways are aligned as depicted, fluid flow may pass from upper fluid passageway 804 to lower fluid passageway 806 through passageways 816, 818 and 820 un-impeded. O-ring seals 822 and 824 are provided in cavity 808 for contacting with the discs, and sealing the cavity from fluid intrusion, as fluid flows through the passageways. When the center disc 812 is axially rotated to move passageway 818 out of alignment, and a solid portion of center disc 812 moved into the flow port, fluid flow will cease through tool 800 as fluid communication between upper fluid passageway 804 and lower fluid passageway 806 is selectively interrupted. In some cases, the passageways 816, 818 and 820 in ceramic discs 810, 812 and 814 are closed at once, or in some other aspects, the one or two of the passageways are selected for closure. Rotation may be delivered to the center disc 812, or any of the discs shown, by a sleeve disposed around the tool provided with a mechanical gear, which rotates drive pin 826. A gear inside the blow out preventer stack may be used to engage the gear sleeve. Racks 828 (two shown) may be attached to blow out preventer rams to provide rotary motion to ceramic discs 810, 812 and/or 814, or rotary motion may be transferred through a pressure barrier between a pair of sealing rams. An eccentric bushing may be used to move a worm gear in and out of engagement with the gear sleeve. Continuous rotation in one or two directions allows re-cycling in the event of operational problems.

Figure 9A:
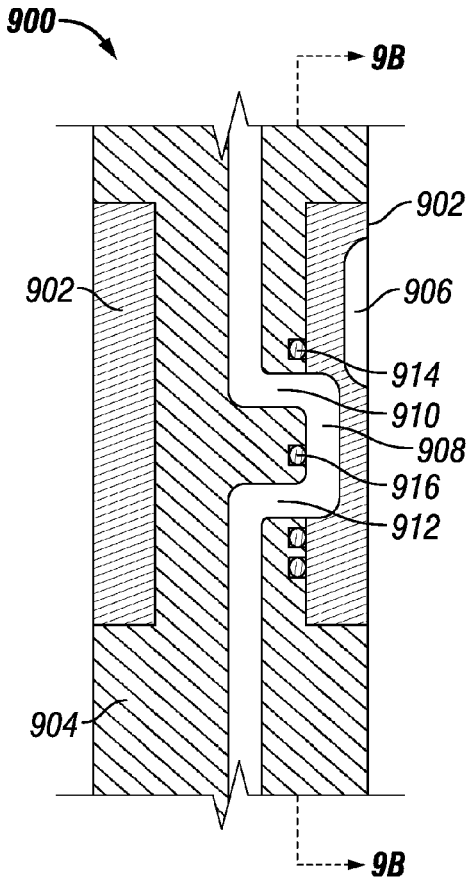
FIGS. 9A and 9B show in a cross-sectional view, a rotating sleeve valve arrangement used in some tools, according to the disclosure.
Figure 9B:
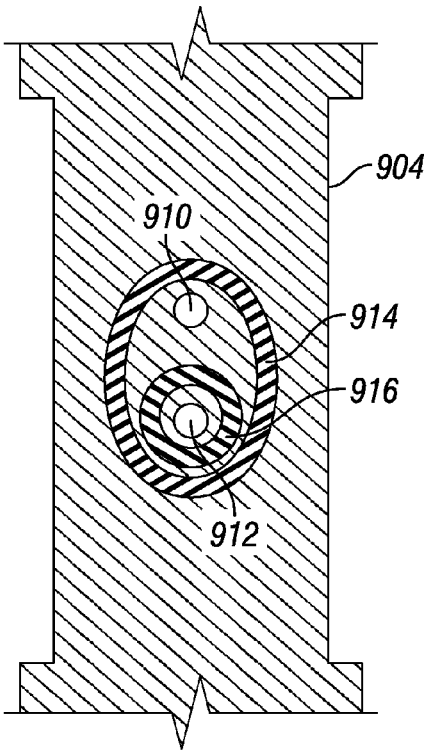

FIGS. 9A and 9B depict a tool embodiment, 900, shown in cross-sectional and perspective views, which operates using a sleeve 902 that coaxially rotates around the periphery of tool body 904, relative centerline '9B', as shown in FIG. 9A. Sleeve 902, functioning as a rotating sleeve valve, includes a gear rack 906 for engaging, and being driven by, a ram in a blow out preventer, or other suitable well head mounted equipment, within which tool 900 is disposed adjacent. Sleeve 902 further includes a pocket 908 therein for providing, or cutting off, fluid communication between upper fluid passageway 910, which extends through an upper portion of tool 900, and lower fluid passageway 912, extending through an lower portion of tool 900. FIG. 9B shows a cross-sectional view of a portion of tool body 904 depicted along plane '9B' illustrated FIG. 9A, and without showing sleeve 902. Both FIGS. 9A and 9B show oval seal 914 and circular seal 916 disposed within tool body 904, which provide a sealed fluid flow path through passageways 910, 912, and pocket 908 (shown in an open position in FIG. 9A). When sleeve 902 is rotated axially into a closed position, fluid communication between passageways 910 and 912 is cut off, or otherwise selectively interrupted, as pocket 908 is moved out of alignment with passageways 910 and 912. Seals 914 and 916 further ensure fluid communication between passageways 910 and 912 is interrupted, no leakage occurs, and no flow through tool body 904 possible, with sleeve 902 in a closed position. While the embodiment depicted in FIGS. 9A and 9B shows a rotating sleeve, operated by gear rack, in some other cases, rotation may be driven by a J-slot mechanism actuated by either a set down location as discussed above, or by applying fluid pressure.

Figure 10:
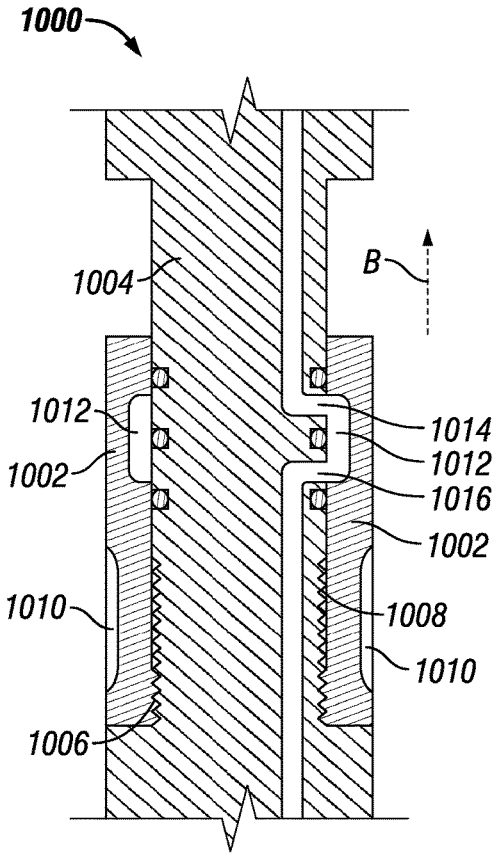
FIG. 10 depicts in a cross-sectional view, a rotating sliding sleeve valve arrangement used in some tools, according to the disclosure; and, FIG. 11 illustrates in a cross-sectional view, a sliding sleeve valve arrangement used in some tools, according to the disclosure.

In another embodiment, illustrated in FIG. 10 in cross-sectional view, tool 1000, having similar structures as those described in FIGS. 9A and 9B, includes sleeve 1002 disposed around tool body 1004, and which rotates around the center axis of the body, and acts as a rotating sliding sleeve valve. An end portion of sleeve 1002 includes threads 1006 for engagement with threads 1008 disposed on tool body 1004. Sleeve 1002 includes a gear rack 1010 for engaging, and being driven by, a drive pinion from suitable wellhead mounted equipment, within which tool 1000 is placed. Sleeve 1002 further includes a pocket 1012 therein for controlling fluid communication between upper fluid passageway 1014 and lower fluid passageway 1016. As shown in FIG. 10, fluid communication between upper fluid passageway 1014 and lower fluid passageway 1016 is established by pocket 1012 in an open position, thereby allowing treatment fluid to pass through tool 1000. In order to close pocket 1012 for isolating upper fluid passageway 1014 from lower fluid passageway 1016, thus selectively interrupting treatment fluid flow through tool 1000, a pinion engaged with gear rack 1010 rotates on an axis perpendicular to the tool center axis, which in turn rotates sleeve 1002 in direction 'B' along the path of threads 1006 and threads 1008. As sleeve 1002 moves along threads 1006 and threads 1008, pocket 1012 is forced out of alignment with fluid passageway 1014 and fluid passageway 1016 until fluid flow through tool 1000 is completely interrupted.

Figure 11:
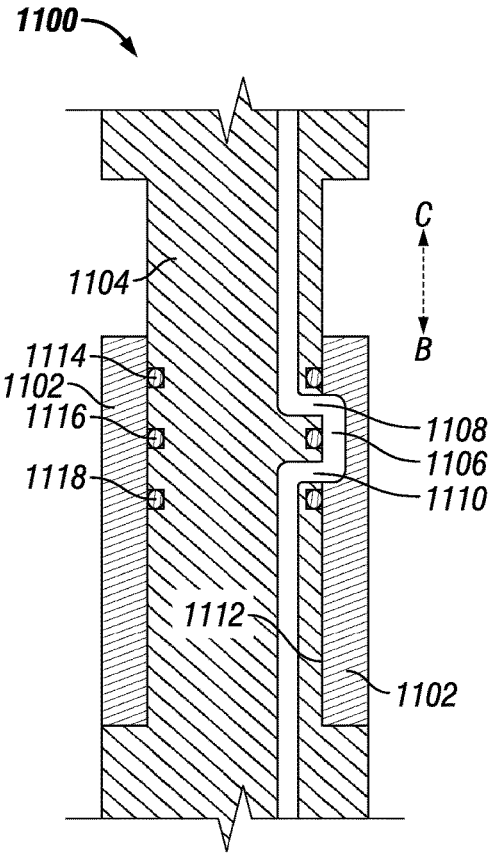

FIG. 11 depicts another tool embodiment, tool 1100, shown in a cross-sectional view, operates using a sleeve 1102 which coaxially slides on the periphery of tool body 1104, relative the tool center axis. Tool 1100, containing a sliding sleeve valve, may have similar structures as those described in FIG. 10. Sliding motion of sleeve 1102 will allow pocket 1106 to control fluid communication between upper fluid passageway 1108 and lower fluid passageway 1110. Sleeve 1102 may be moved to an open position 'B' as shown, or closed position 'C', by a mechanical device positioned adjacent tool 1100, and may be a device such as a tool trap or blow out preventer ram, which engages and slide sleeve 1102. When in an open position, pocket 1106 allows contiguous fluid flow through tool 1100 via upper fluid passageway 1108 and lower fluid passageway 1110. When in a closed position, blank area 1112 on sleeve 1102 occludes end openings in lower fluid passageway 1110 and as required, upper fluid passageway 1108. Seals 1114, 1116 and 1118 may ensure fluid communication between passageways 1106 and 1108 is selectively interrupted, no leakage occurs, and no flow through tool body 1104 possible, with sleeve 1102 in a closed position. In an open position, seals 1114 and 1118 maintain sealed fluid flow through tool 1100. The geometry of pocket 1106 may be an asymmetric pocket as depicted, or symmetrical cavity extending around the inside surface of sleeve 1102, such as shown in FIG. 10.

In some further aspects, one or more of the valve elements may be combined to provide redundant sealing means or sealing means for two or more fluid passages. Additionally, a pressure testing means (such as smaller fluid ports) may be provided such that the pressure sealing capacity of the valve may be ascertained before they are required to seal wellbore pressure.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for deploying a coiled tubing string into a wellbore comprising:

providing a coiled tubing having a distal end and an opposing end connected with a reel;

providing a tool comprising a tool body, a first fluid passageway and a second fluid passageway defined within the tool body, a valve disposed within the tool body and interposed between the first fluid passageway and the second fluid passageway, the valve operable under wellbore pressure and configured to selectively interrupt wellbore pressure communication through the tool body during deployment;

providing a deployment bar attached to the tool body;

connecting the distal end of the coiled tubing with one end of the deployment bar;

connecting the tool with a second end of the deployment bar;

establishing fluid communication through the distal end of the coiled tubing and the first fluid passageway and the second fluid passageway; and, deploying the coiled tubing, the deployment bar, and the tool into the wellbore.

2. The method of claim 1 further comprising selectively interrupting the fluid communication by closure of the valve while exposed to wellbore pressure.

3. The method of claim 1 wherein the tool is secured in the wellbore by one or more blow out preventer rams, and wherein the valve is exposed to wellbore pressure below the one or more blow out preventer rams.

4. The method of claim 3 further comprising selectively interrupting the fluid communication by closure of the valve while exposed to the wellbore pressure, and when pressure above the one or more blow out preventer rams decreases.

5. The method of claim 1 wherein the tool is secured in the wellbore by two sets of blow out preventer rams defining a cavity there between, and wherein the fluid communication is selectively interrupted by closure of the valve when pressure in the cavity is increased above pressure in the first fluid passageway and the second fluid passageway.

6. The method of claim 1 further comprising selectively interrupting the fluid communication by closure of the valve by set down load.

7. The method of claim 1 further comprising selectively interrupting the fluid communication by closure of the valve by mechanical engagement with a device adjacent the tool.

8. The method of claim 1 wherein the valve is one of a poppet valve, a disc valve, a rotating sleeve valve, a rotating sliding sleeve valve, spool valve, a ball valve or a sliding sleeve valve.

9. The method of claim 1 wherein the valve remains closed with or without a valve actuating means being applied when pressure in the second fluid passageway is higher than pressure in the first fluid passageway.

10. The method of claim 1 wherein the valve opens when pressure in the first passageway is higher than pressure in the second passageway notwithstanding a state of a valve actuating means.

11. The method of claim 1 wherein the tool body comprises a second valve operable under wellbore pressure disposed within the tool body.

12. The method of claim 11 wherein testing means are provided to verify the sealing action of the valves.

13. A system for deploying coiled tubing comprising:

a coiled tubing having a distal end and an opposing end connected with a reel;

a tool comprising a tool body, a valve operable under wellbore pressure disposed within the tool body, and a first fluid passageway and a second fluid passageway defined within the tool body, wherein the coiled tubing, the first fluid passageway and the second fluid passageway are in fluid communication wherein fluid communication within the first and second fluid passageways is selectively interruptable by closure of the valve while exposed to wellbore pressure;

a deployment bar connected to the distal end of the coiled tubing on a first end thereof and connected to the tool on a second end thereof;

a wellbore, wellhead and a blowout preventer within which the coiled tubing, deployment bar, and the tool are deployable; and, a treatment fluid flowable through the distal end of the coiled tubing, the deployment bar the first fluid passageway and the second fluid passageway.

14. The system of claim 13 wherein the tool is secured by one or more blow out preventer rams, and wherein the valve is exposed to wellbore pressure below the one or more blow out preventer rams.

15. The system of claim 14 wherein the fluid communication is selectively interruptable by closure of the valve while exposed to the wellbore pressure, and when pressure above the one or more blow out preventer rams decreases.

16. The system of claim 13 wherein the tool is secured in the wellbore by two sets of blow out preventer rams defining a cavity there between, and wherein the fluid communication is selectively interruptable by closure of the valve when pressure in the cavity is increased above pressure in the first fluid passageway and the second fluid passageway.

17. The system of claim 13 wherein the valve remains closed with or without a valve actuating means being applied when pressure in the second fluid passageway is higher than pressure in the first fluid passageway.

18. The system of claim 13 wherein the valve opens when pressure in the first passageway is higher than pressure in the second passageway notwithstanding a state of a valve actuating means.

19. The system of claim 13 wherein the fluid communication is selectively interruptible by closure of the valve by set down load.

20. The system of claim 13 wherein the fluid communication is selectively interruptible by closure of the valve by mechanical engagement with a device adjacent the tool.

21. The system of claim 13 wherein the valve is one of a poppet valve, a disc valve, a rotating sleeve valve, a rotating sliding sleeve valve or a sliding sleeve valve.

22. An apparatus comprising a tool body, a valve operable under wellbore pressure disposed within the tool body, and a first fluid passageway and a second fluid passageway defined within the tool body, wherein the first fluid passageway and the second fluid passageway are in fluid communication, and wherein the fluid communication is selectively interruptible with the valve, the valve providing a well barrier when closed, in conjunction with an annular sealing device on the tool body.

23. The apparatus of claim 22 wherein the fluid communication is selectively interruptible by closure of the valve when exposed to wellbore pressure.

24. The apparatus of claim 22 wherein the annular sealing device comprises one or more blow out preventer rams and wherein secured by one or more blow out preventer rams, wherein the fluid communication is selectively interruptible by closure of the valve while exposed to the wellbore pressure and while pressure above the one or more blow out preventer rams decreases.

25. The apparatus of claim 22 wherein the fluid communication is selectively interruptible by closure of the valve by set down load.

26. The apparatus of claim 22 wherein the fluid communication is selectively interruptible by closure of the valve by mechanical engagement with a device adjacent the tool.

27. The apparatus of claim 22 wherein the valve is one of a poppet valve, a disc valve, a rotating sleeve valve, a rotating sliding sleeve valve, a spool valve, a ball valve, or a sliding sleeve valve.

* * * * *